US005115250A

United States Patent [19]

Harmon et al.

[11] Patent Number: 5,115,250

[45] Date of Patent: May 19, 1992

[54] WIPER FOR INK-JET PRINTHEAD

[75] Inventors: J. P. Harmon, Washougal, Wash.; George T. Kaplinsky, San Diego, Calif.

[73] Assignee: Hewlett-Packard Company, Palo Alto, Calif.

[21] Appl. No.: 463,755

[22] Filed: Jan. 12, 1990

[51] Int. Cl.[5] ..... B41J 2/165

[52] U.S. Cl. ..... 346/1.1; 346/140 R

[58] Field of Search ..... 346/140 PD, 1.1, 140 R, 346/75; 400/126

[56] References Cited

U.S. PATENT DOCUMENTS

| | | | |
|---|---|---|---|
| 4,436,439 | 3/1984 | Koto | 346/140 X |
| 4,577,203 | 3/1986 | Kawamura | 346/140 R |
| 4,745,414 | 5/1988 | Okamura et al. | 346/140 |
| 4,853,717 | 8/1989 | Harmon et al. | 346/140 R |
| 4,872,026 | 10/1989 | Rasmussen et al. | 346/140 R |
| 4,959,673 | 9/1990 | Noda | 346/140 |
| 4,977,459 | 12/1990 | Ebinuma et al. | 346/140 X |

FOREIGN PATENT DOCUMENTS

| | | | |
|---|---|---|---|
| 58-3870 | 1/1983 | Japan . | |
| 58-194557 | 11/1983 | Japan . | |
| 0045163 | 3/1984 | Japan . | |
| 62-77943 | 4/1987 | Japan . | |
| 0251145 | 10/1987 | Japan | 346/140 |

*Primary Examiner*—Benjamin R. Fuller
*Assistant Examiner*—Alrick Bobb

[57] ABSTRACT

A rotary wiper for cleaning the orifice plate of a printhead of a thermal ink-jet printer. The wiper includes a plurality of blades which successively wipe contaminants from the orifice plate of the printhead during rotation of the wiper. Apparatus is provided for automatically cleaning the contaminants from the blades of the rotating wiper. The wiper blades are either radially or non-radially oriented. The cleaning apparatus includes either a plurality of scrapers, or a roll of liquid absorbing material. The wiper is rotated by a motor, or by a rack and pinion arrangement, in which the rack is disposed on the printhead carriage and actuates the wiper as the printhead moves into the service station area. In one embodiment the wiper is used in conjunction with a cap in the service station area to clean and then seal the printhead.

39 Claims, 4 Drawing Sheets

WIPER FOR INK-JET PRINTHEAD

FIELD OF THE INVENTION

This invention relates generally to ink-jet printers and printheads and more particularly to a wiper for automatic cleaning of the printhead.

BACKGROUND OF THE INVENTION

The orifice plate of the printhead of an ink-jet printer, particularly a thermal ink-jet printer, tends to pick up contaminants, such as paper dust, and the like, during the printing process. Such contaminants adhere to the orifice plate either because of the presence of ink on the printhead, or because of electrostatic charges. In addition, excess ink can accumulate around the printhead, if all the ink is not pumped out of the printhead. The accumulation of either ink or other contaminants can impair the quality of the output by interfering with the proper application of ink to the printing medium. For these reasons, it is desirable to clear the printhead orifice plate of such contaminants on a routine basis to prevent the build-up thereof.

Wipers are known in the prior art for removal of contaminants from the orifice plate of the printhead. One type of stationary wiper found on existing machines is described in U.S. patent application Ser. No. 149,454, now U.S. Pat. No. 4,872,026 issued Oct. 3, 1989 filed on Jan. 28, 1988 and assigned to the assignee of the present application. This wiper typically comprises a resilient material, such as nitrile rubber, and is disposed in the service station area of the printer. The service station provides a region at one end of the bi-directional movement of the print head carriage which holds the printhead carriage in locked alignment. Typically, the printhead is dragged across a stationary wiper blade as the printhead carriage moves into the service station area. The wiper itself is cleaned by downwardly facing edges on a lower side of the printhead which are dragged across the wiper subsequent to the printhead.

Another type of prior art printhead wiper includes a flat ring having a plurality of upstanding, resilient, widely spaced blades disposed on an outer surface thereof. The blades are disposed generally orthogonally of the ring. The ring typically is stretched between two shafts, and this ring is selectively driven by a motor or other like device which is coupled to the pulleys. No means for automatically cleaning the blades is provided. An example of this wiper is described in U.S. Pat. No. 4,577,203.

Prior art wipers, including those described hereinabove, suffer from a number of drawbacks. In the first place, inadequate means are provided to remove contaminants from the wiper itself after it has cleaned the printhead orifice plate. Contaminants are only periodically removed and the apparatus used for removal does not entirely clean the wiper after each use. As a result, subsequent passes of the wiper over the printhead tend to recontaminate the printhead. Secondly, inadequate cleaning is provided because typically only one upstanding wiper blade wipes the printhead during each pass of the printhead over the wiper, thus removing only some of the contaminants during any one pass. A number of passes is required to remove a sufficient amount of such contaminants.

It is therefore an object of the present invention to provide a wiper for an ink-jet printer which removes substantially all of the dust, ink and other contaminants from the printhead orifice plate during each pass of the printhead over the wiper.

It is a further object of the present invention to provide a wiper for an ink-jet printer which includes means for automatically cleaning the wiper as it wipes the orifice plate of the printhead.

It is another object of the present invention to provide a simplified wiper mechanism which is effective in removing paper dust, ink and other contaminants from the printhead orifice plate of an ink-jet printer.

It is another further object of the present invention to provide a simplified wiper for ink-jet printers which is actuated only when the printhead passes thereover.

SUMMARY OF THE INVENTION

The above and other objects are achieved in accordance with the present invention in which a multi-blade, rotary wiper is provided for removal of ink, dust and other contaminants from the orifice plate of a printhead of an ink-jet printer. Furthermore, apparatus is provided for continual, automatic cleaning of the wiper blades.

The wiper has one or a plurality of blades which extend outwardly from the center or axis of rotation of the wiper. These blades are closely spaced, and typically are formed of a resilient material, such as nitrile rubber. The blades may have a radial orientation or they may be disposed at an angle with respect to a wiper radius.

Arrayed around the perimeter of the wiper at locations spaced from the cleaning area where the wiper blades engage the printhead are a plurality of rigid cleaning blades formed of metal or another like material. These rigid blades have upper edges, across which the wiper blades pass after cleaning of the printhead orifice plate to scrape the ink, dust and other contaminants off the wiper blades.

Alternatively, the cleaning apparatus may comprise a roller covered with an absorbent material. This roller is disposed just below the wiper and spaced from the cleaning area, so that the wiper blades pass over and rub against the roller after cleaning of the printhead. Contaminants are removed by rubbing of the wiper blades against the roller, and by absorption of the ink.

In a preferred embodiment, the rotary wiper of this invention is disposed in the service station area of the ink jet printer. Typically, although not necessarily, operation of the wiper is triggered by entry of the printhead carriage into the service station area. The rotary wiper can be driven either by a servomotor, or by a rack and pinion arrangement. In the latter embodiment, a rack is disposed on the lower surface of the printhead carriage, and as the rack approaches the service station area, it produces rotation of the rotary wiper through interaction with a pinion gear disposed on the wiper shaft. The wiper then cleans the printhead orifice through multiple strikes, and after the printhead has passed, the wiper ceases rotation.

Use of the foregoing rotary wiper permits automatic, effective and complete removal of ink, dust and other contaminants from the printhead orifice plate when the printhead carriage is in the service station area, and automatic cleaning of the wiper blades while the printhead is being wiped. As a consequence, the quality of the printing process is not impaired by contaminants on the printhead, regardless of the length of time during which the printer is operated without maintenance.

BRIEF DESCRIPTION OF THE DRAWINGS

The objects, advantages and features of this invention will be more clearly appreciated from the following detailed description taken in conjunction with the accompanying drawings in which.

DETAILED DESCRIPTION OF THE PREFERRED EMBODIMENTS

Figure 1:
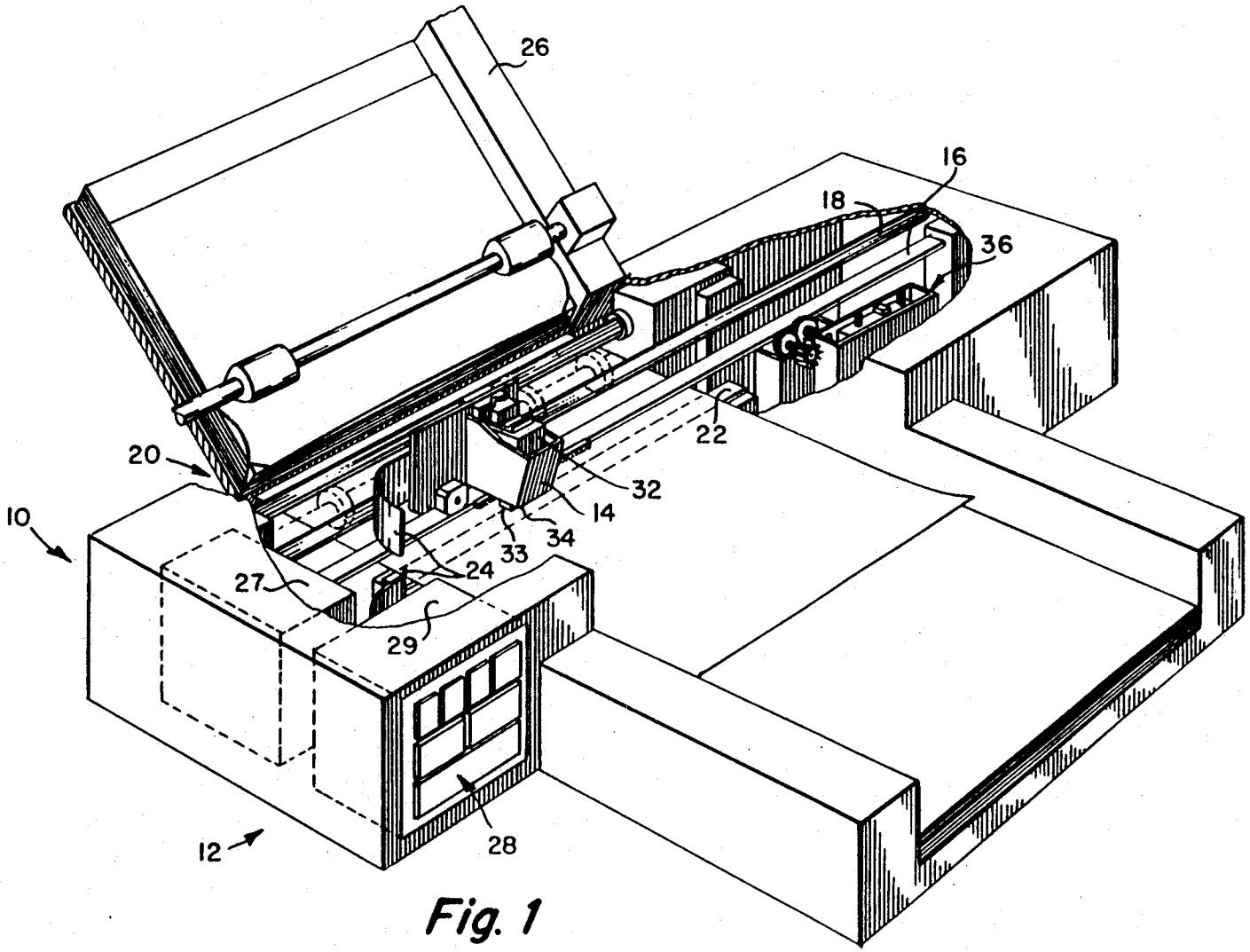
FIG. 1 is a perspective view of an ink-jet printer containing the wiper of this invention.

With reference now to the drawings, and more particularly to FIG. 1 thereof, a typical ink-jet printer 10 will be described with which the wiper of this invention may be used. Ink-jet printer 10, as shown in the drawings, is of the type in which printing is done in a substantially horizontal plane. However, it is to be understood that the wiper of this invention is shown used in conjunction with this type of printer for purposes of illustration only and that the wiper of this invention can be used with other types of ink-jet printers in which printing is not done in a substantially horizontal plane and which have different configurations.

Ink-jet printer 10 includes a housing 12, a printhead carriage 14, a carriage guide 16, a carriage rod 18, drive roller assembly 20, platen 22, paper supply 26, and service station 36. Drive roller assembly 20 feeds paper, or another print medium, supplied to it by paper supply 26 to a printing zone disposed between print head carriage 14 and platen 22 in a manner well known to those skilled in the art. Printhead carriage 14 travels back and forth on carriage rod 18 and carriage guide 16 through the printing zone. Printhead carriage 14 is moved bi-directionally typically by means of a belt (not shown) connected to a carriage motor 27. Printhead carriage 14 includes a print cartridge 32 which is connected by flexible electrical interconnect strip 24 to a microprocessor 29. Microprocessor 29 also controls carriage motor 27. A control panel 28 is electrically associated with microprocessor 29 for selection of various options relating to the printing operation. Such control operations, provided by presently available microprocessors, are well known in the prior art and form no part of this invention.

Printhead cartridge 32 includes a printhead 33 provided on a bottom surface 34 thereof. Typically, printhead 33 is a thermal ink-jet printhead. However, printer 10 could operate with other ink jet printheads, if the carriage interfaces are compatible, or with other carriage configurations. Furthermore, reconfiguration of cartridge 32 would permit use of other ink jet technologies, such as piezoelectric. Printhead 33 typically comprises a plurality of resistors (not shown) associated with a plurality of nozzles (not shown) formed in a nozzle plate 35. Ink (not shown) is stored in a reservoir within cartridge 32. Printhead cartridge 32 and printhead 33 operate in a manner well known to those skilled in the art.

Figure 2A:
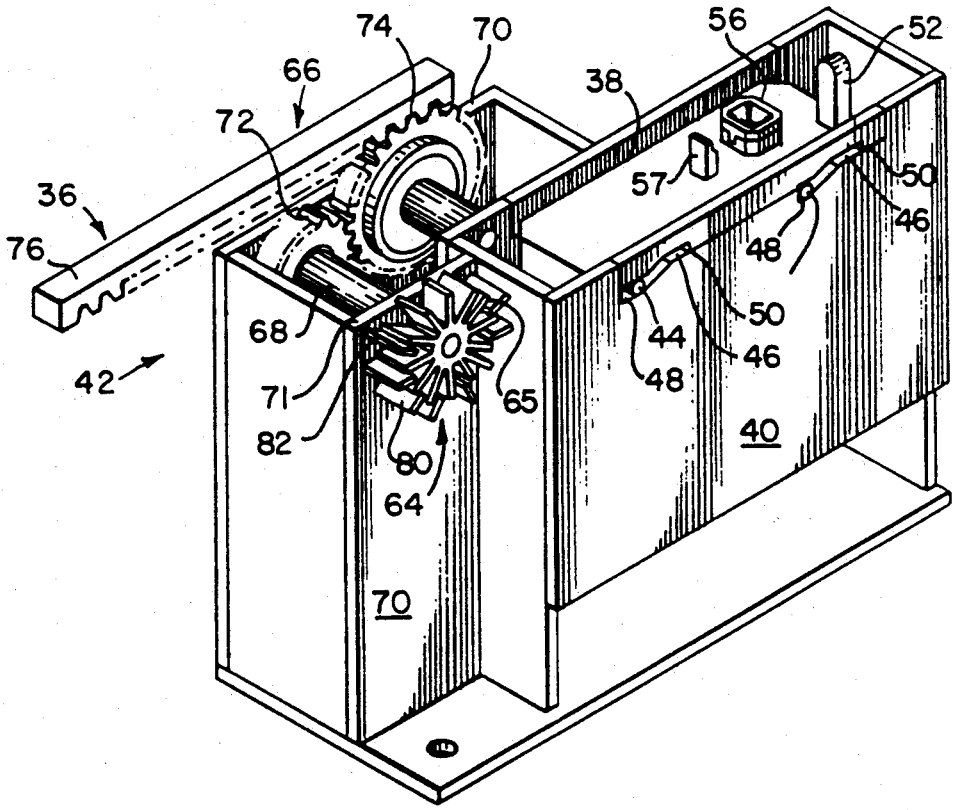
FIG. 2A is a partial, isometric view of the service station area of the printer of FIG. 1 showing the sled in one position.
Figure 2B:
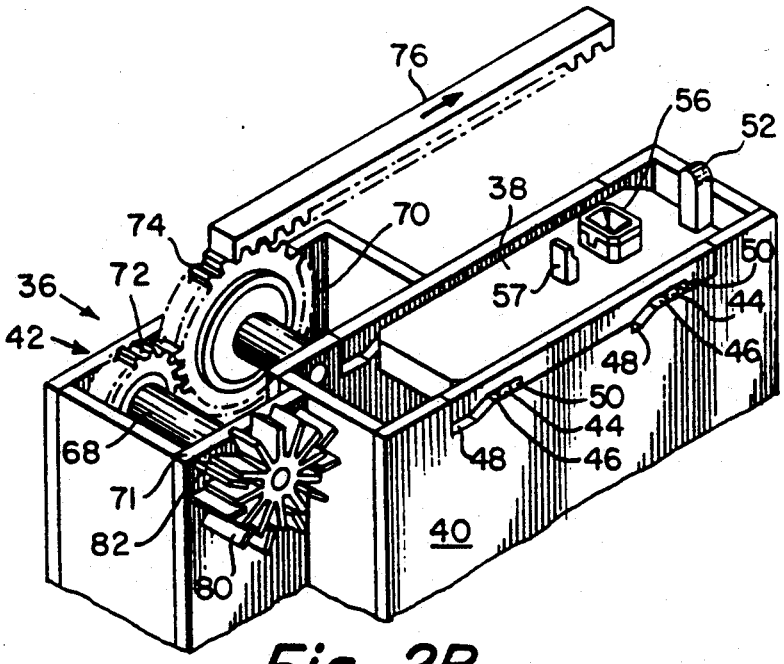
FIG. 2B is a partial, isometric view of the service station area of the printer of FIG. 1 showing the sled in another position.

An assembled service station 36 which includes the wiper of this invention is depicted in FIGS. 2A and 2B. Service station 36 is a region at one end of the bi-directional movement of carriage 14 which holds cartridge 32 in locked alignment. Service station 36 includes a wiper mechanism, designated generally as 42. In the exemplary printer 10 with which this invention is being described, service station 36 also may include a sled 38, a sled support 40 and a peristaltic pump (not shown). However, the sled 38 and pump form no part of this invention and are not required for its operation.

Bosses 44 disposed on the sides of sled 38 rest on ramps 46 of sled support 40. Sled 38 is moveable along ramps 46 of sled support 40 from left to right and right to left as shown in FIG. 2A. Bosses 44 ride up along associated ramps 46 as the sled moves from left to right as shown in FIG. 2A, from a lower portion 48 to an upper portion 50, and visa versa. As sled 38 is in its most left-hand position, as shown in FIG. 2A, bosses 44 reside in lower portion 48, while when sled 38 is in its most right-hand position as shown in FIG. 2B, bosses 44 reside in upper portion 50 of ramp 46. Sled 38 includes an upwardly extending projection 52 which is engaged by a surface of carriage 14, typically a pen support 54, as it moves into service station 36. As pen support 54 strikes projection 52, cap 56 on sled 38 is automatically aligned with printhead 33. Further movement to the right of sled 38 causes sled 38 to rise upwardly on ramps 46 and causes cap 56 to be pressed against the perimeter of the orifice plate of printhead 33 for sealing thereof. Also, as sled 38 rises upwardly on ramps 46, a pen catcher 57 enters into a slot 58 in printhead 33. Thus, when carriage 14 subsequently leaves service station 36, pen catcher 57 ensures that the sled 38 is returned to its inactive, lower position as shown in FIG. 2, in which bosses 44 reside in lower portion 48 of ramp 46. Pen catcher 57 drops out of slot 58 as sled 38 is lowered to its inactive position.

The purpose of the ramped sled motion is to prevent wear on cap 56 so that it will not need to be replaced during the life of the printer. This ramped motion also allows movement of printhead 33 into a position to activate the peristaltic pump while being capped.

The wiper mechanism of this invention will now be described with particular reference to FIGS. 2-10. Typically, wiper mechanism 42 is disposed in service station 36 on a side of sled 38 facing the center of the printer so that printhead 33 moves across mechanism 42 prior to capping. Wiper mechanism 42 includes a wiper 60 having at least one blade 62, apparatus 64 for cleaning blades 62 and mechanism 66 for rotating wiper 60 about central shaft 68.

In a preferred embodiment, as shown in FIGS. 2A and 2B, wiper 60 includes a plurality of blades 62 which are about equally spaced and extend radially from a central axis coincident with shaft 68. Blades 62 each have distal tips 65 which serve to wipe the orifice plate of the printhead. Wiper 60 is centrally mounted on shaft 68 which is journaled in supporting walls 70 in service station 36 to permit rotation of wiper 60 about shaft 68. All blades 62 are of substantially the same length, and tips 65 generally define a circle, whether stationary or rotating. An upper portion of that circle extends above the upper edge 71 of wall 70 into the cleaning area where tips 65 wipe printhead 33 and a lower portion of that circle extends into apparatus 64. Rotation of wiper 60 produces multiple passes of blade tips 65 over orifice plate 35 each time printhead 33 enters service station 36. Also, rotation permits the blades 62 to be automatically cleaned by apparatus 64, as will be described hereinbelow. Preferably, wiper 60 has a large number of blades 62 to facilitate the desired repeated wiping action. Wiper 60 should be formed of a resilient material, such as a nitrile rubber and the like, so that as tips 65 of blades 62 pass over and wipe printhead 33, they flex to accommodate the irregular surface of printhead 33 and return to their original configuration without substantial deformation. The radial orientation of blades 62 provides a firm and aggressive wiping action along tips 65 which is preferred for satisfactory removal of dust, ink and other contaminants from printhead 33.

Figure 3:
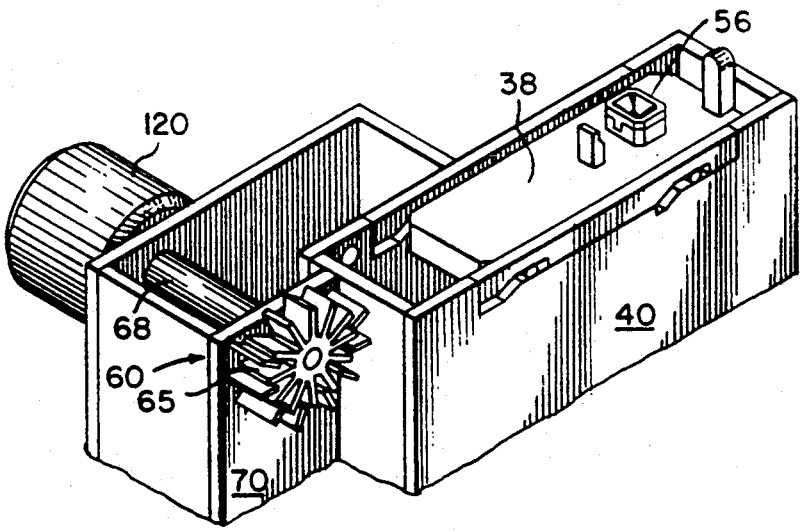
FIG. 3 is a partial, isometric view of the service station area of the printer of FIG. 1 showing an alternative driving mechanism for the wiper of this invention.

Rotation of wiper 60 can be produced either by a separate servomotor or the like, as shown in FIG. 3, or, rotation can be produced mechanically by movement of carriage 14. In a preferred embodiment, a gearing arrangement produces the desired rotation, as shown in FIGS. 2 and 4–6. In this embodiment, a driving gear 72 is disposed on shaft 68. Typically, although not necessarily, pear 72 is driven by another, larger pinion gear 74, and pear 74 is in turn rotated by a rack 76. It should be understood that any number of gears may be used to couple rack 76 to gear 72, or rack 76 may directly engage gear 72, depending upon the speed and direction of rotation desired for shaft 68. Rack 76 is coupled to or driven by printhead carriage 14.

The preferred arrangement shown in FIGS. 2, and 4–6 which utilizes gears 72 and 74 and rack 76 rotates wiper 60, at the desired speed and in the desired direction, as printhead 33 moves into and out of service station 36. This arrangement causes blade tips 65 of wiper 60 to move in a direction which is opposite of the direction of movement of printhead 33 during wiping thereof in the cleaning area. Wiper 60 rotates in a counterclockwise direction as viewed in FIG. 4, so that blade tips 65 travel from right to left in the cleaning area as printhead carriage 14 moves from left to right in FIG. 4. Similarly, wiper 60 rotates in a clockwise direction so that blade tips 65 travel from left to right in the cleaning area as printhead carriage 14 moves from right to left in FIG. 4. In this manner, printhead 33 is cleaned both upon its arrival in service station 36, and as it departs, so that it is clean and ready for use as it returns to the printing zone. This travel of blade tips 65 in a direction opposite of the direction of movement of printhead 33 produces a more vigorous and effective wiping action of blade 62 against printhead 33. It should be understood that while pears 72 and 74 provide a preferred speed of rotation for wiper 60, other gears of different sizes and other numbers of gears may be provided to change the rotational speed and direction of wiper 60. However, only an even number of additional gears should be added to the gear train of FIG. 2 if the preferred opposite direction of rotation for wiper blade tips 65 is to be maintained. The particular pear reduction ratio selected depends on the desired speed of rotation of wiper 60.

In a preferred embodiment, rack 76 is permanently secured to a lower surface of printhead carriage 14. In this manner, rotation of wiper 60 occurs only when carriage 14 is entering or leaving service station 36 and when printhead 33 is disposed above wiper 60 in the cleaning area. Preferably, rack 76 should extend sufficiently far beyond printhead carriage 14 in its direction of motion toward service station 36 that rotation of shaft of 68, and thus wiper 60 is commenced prior to the passage of printhead 33 over wiper 60.

In an alternative embodiment, (not shown) rack 76 need not be secured directly to printhead carriage 14, but could be actuable by printhead carriage 14 as it moves into service station 36, either by a mechanical coupling or by an electrical stimulus.

The rack and pinion wiper driving arrangement of FIGS. 2A and 2B can be replaced by the embodiment of FIG. 3 in which like numbers are used for like parts, where possible. As shown in FIG. 3, shaft 68 and thus wiper 60 is rotated by a servomotor 120. Motor 120 typically is controlled by the microprocessor to operate only when carriage 14 is entering or leaving service station 36. However, motor 120 may also be continuously running. Preferably, motor 120 rotates wiper 60 so that blade tips 65 travel in a direction opposite of the direction of movement of carriage 14, as previously described for the embodiment of FIGS. 2 and 4–6. In all other respects, the embodiment of FIG. 3 operates like the embodiment of FIGS. 2 and 4–6.

Apparatus 64 for cleaning blades 62 renders wiper 60 continually self cleaning, so that as blades 62 pass over printhead 33, they do not recontaminate printhead 33. This self-cleaning action reduces the servicing requirements, since wiper 60 need not be replaced except after a long period of use.

Figure 4:
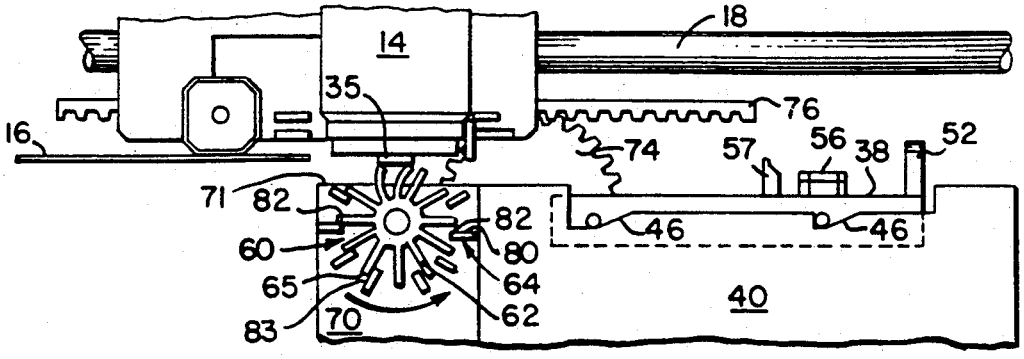
FIG. 4 is a front, plan view of the service station of FIG. 2 showing the printhead carriage approaching the service station.
Figure 5:
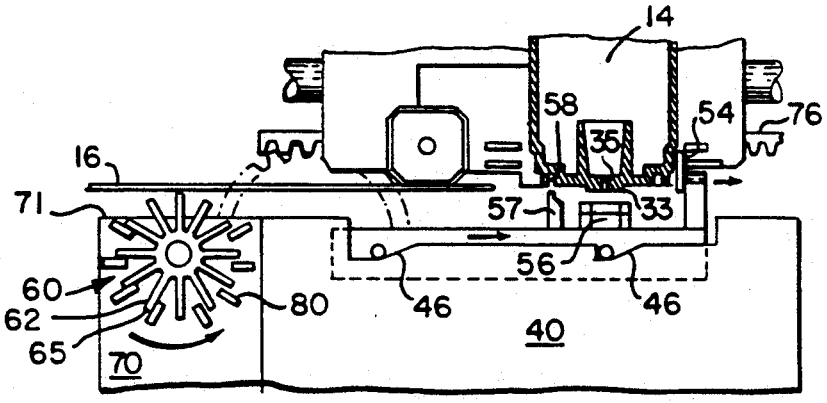
FIG. 5 is a front, partially cutaway, plan view of the service station of FIG. 2 showing the printhead carriage in the service station.
Figure 6:
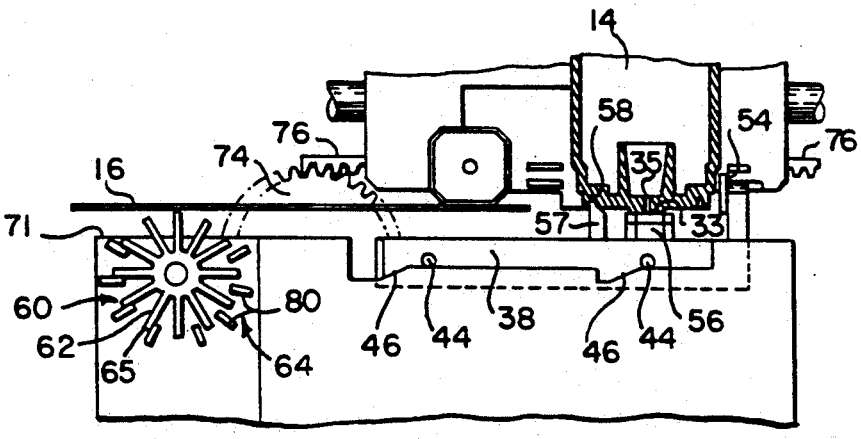
FIG. 6 is a front, partially cutaway, plan view of the service station of FIG. 2 showing the printhead carriage in a capped position.

In a preferred embodiment, cleaning apparatus 64 comprises at least one and preferably a plurality of scrapers 80 arrayed around at least a portion of the circumference of the circle defined by the rotating blade tips 65 of wiper 60. Scrapers 80 comprise rigid blades having an edge 82 that faces inwardly toward shaft 68 and that rides along a portion of each blade 62 that passes thereover to perform the desired scraping action. Edge 82 may or may not be sharpened. Preferably, scrapers 80 have an orientation generally parallel to blades 62 and to a radius of the circle defined by tips 65. Scrapers 80 typically have approximately the same circumferential spacing as tips 65 alone the circumference of the circle defined by rotating tips 65. Scrapers 80 may also have a non-radial alignment and any other spacing that does not conform to that of tips 65, so long as tips 65 are dragged across edges 82 of the scrapers during rotation of wiper 60. Scrapers 80 are rigidly mounted onto wall 70 so that they do not move or flex as blades 62 pass thereover. As shown in FIGS. 4–6, edges 82 of scrapers 80 extend beyond tips 65 of blades 62 and edges 82 are spaced inwardly from tips 65 toward shaft 68 so that edges 82 scrape along the lateral surfaces of blade 62 as it flexes while passing over edges 82. This flexing of blades 62 produces a "flicking" action, as the blade tip 65 returns to its original configuration which also helps propel contaminants off tips 65. Scrapers 80 may be disposed around the entire circumference of the circle defined by tips 65 below upper edge 71 of wall 70, as shown in FIG. 2, or only along a portion of the circumference, but there are no scrapers 80 in the area above wall 70.

Because of the rotation of wiper 60, the same side of tips 65 of blade 62 which wipe printhead 33 also are drapped across edges 82 of scrapers 80, so that contaminants removed from printhead 33 are immediately scraped off blades 62 by scrapers 80. In addition, when more than one scraper 80 is provided, each blade 62 is scraped a number of times before it again cleans printhead 33, providing multiple opportunities for removal of contaminants. The number of scrapers 80, the length thereof, as well as their orientation is not critical, so long as the desired scraping action is provided.

Ink and contaminants which are removed from wiper 60 by scrapers 80 tend to move under the influence of gravity by centrifugal acceleration caused by rotation of the wiper, and as a result of the flicking action of blades 62, down the lateral surfaces of scrapers 80 and away from edges 82 until they fall off edges 83 and into machine 10. The ink tends to carry solid contaminants with it. Thus, scrapers 80 are self-cleaning, and need only be cleaned when solid contaminants have built up to an undesirably high level.

Figure 7:
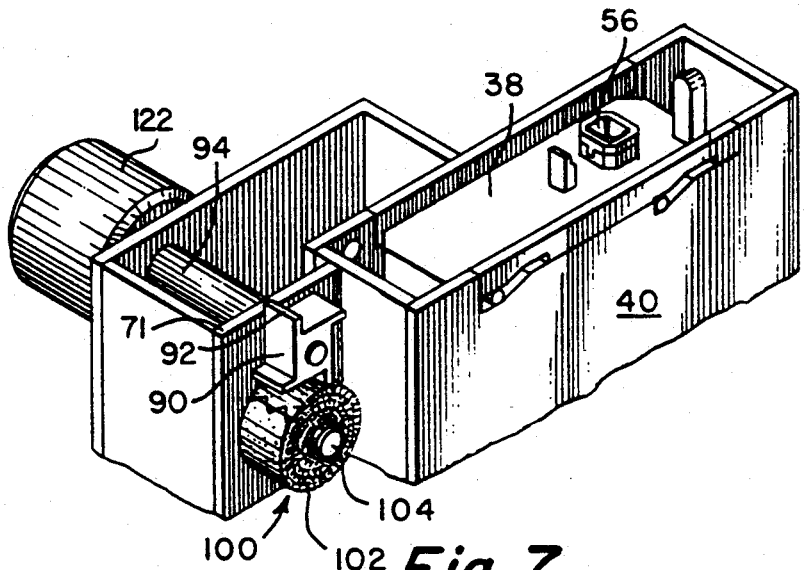
FIG. 7 is partial isometric view showing another embodiment of the wiper of this invention.
Figure 8:
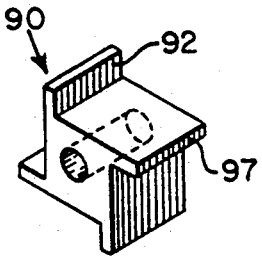
FIG. 8 is an isometric view showing the wiper configuration of FIG. 7.
Figure 9:
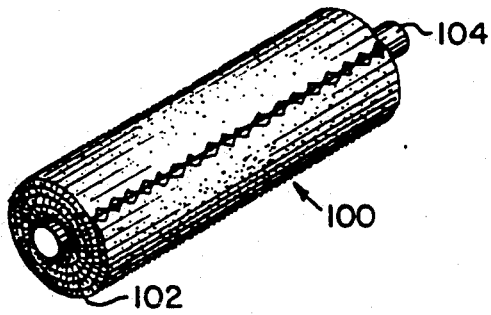
FIG. 9 is an isometric view showing the wiper cleaning apparatus of FIG. 7.

An alternative embodiment of the wiper of this invention is shown in FIGS. 7-9. Like numbers are used for like parts, where possible. In this embodiment, wiper 90 rotates about a shaft 94 and again includes a plurality of blades 92. While four blades are shown, wiper 90 may have any number of blades 92, so long as the desired wiping is performed. Blades 92 are oriented at an angle with respect to a radius extending from shaft 94. This angle is typically about 90°, although the angle may be anywhere in the range of 0° to 90°. Blades 92 have a somewhat greater lateral extent than that of blades 62, because of their angular orientation, so that tips 97 thereof can still reach the cleaning area to provide the desired wiping action. In this embodiment, as in the previous embodiment, wiper 90 rotates in a counterclockwise direction as carriage 14 moves in a direction from left to right into service station 36, as shown in FIG. 7. However, as carriage 14 moves from right to left as it leaves service station 36, it is preferred that no rotation of wiper 90 occur, or that if wiper 90 is rotated, it is again rotated only in a counterclockwise direction. If rotated in a clockwise direction, the tips 97 of blades 92 could interfere with the smooth movement of printhead carriage 14, because of their angular orientation.

Wiper 90 of FIGS. 7-9 preferably is driven by a selectively actuated servomotor 122, as shown in FIG. 7. Servomotor 122 is preferred, rather than the rack and pinion arrangement of FIG. 2 because it permits the wiper to be easily selectively stopped or rotated only in a single direction, as desired. Other drive mechanisms can be used for actuating wiper 90 which are well-known to those skilled in the art to provide the desired rotation of wiper 90. Cleaning apparatus 64 as described for use with wiper 60, can be employed to remove contaminants from wiper 90. In all other respects, wiper 90 operates in the same manner as wiper 60.

An alternative embodiment of the cleaning apparatus for wipers 60 and 90 of this invention will now be described with particular reference to FIGS. 7 and 8. While this cleaning apparatus is shown used in conjunction with wiper 90 for purposes of illustration, it is to be understood that this cleaning apparatus may also be used in conjunction with wiper 60. Like numbers are used for like parts, where possible. In this embodiment, the cleaning apparatus includes a roller 100 having a layer 102 of absorbent material. Roller 100 is rotatably mounted on a shaft 104 which is disposed generally parallel to, but spaced from either shaft 94 or shaft 68. Roller 100 is disposed below edge 71 and is spaced from the cleaning area above edge 71. Roller 100 is positioned so that the outer surface thereof engage tips 97 of wiper 90, or tips 65 of wiper 60 as they rotate about their respective shafts, 68 and 94, after wiping the printhead orifice plate, so that tips 97 of blades 92, or tips 65 of blades 62 are wiped clean. Layer 102 is wrapped about shaft 104, and is comprised of a contaminant free, ink absorbing material. An acceptable, commercially available material is sold under the trademark TEX-WIPE, by Texwipe Corporation. Layer 102 should be removed and replaced at regular intervals as it becomes saturated with ink or other liquids, or as it becomes sufficiently contaminated.

Roller 100 can be stationary, freely rotatable, or rotating under the control of a servomotor. It is preferred that roller 100 be freely rotating, so that as tips 65 or 97 are rubbed against roller 100, they impart a rotation to roller 100 through friction. Roller 100 is then incrementally rotated by each tip 65 or 97 to present a fresh surface to the next tip 65 or 97.

The number of blades provided on wiper 60 or wiper 90 depends on several factors, such as the speed with which the wiper rotates and the number of passes required for the blades over the printhead orifice plate. The number of passes required is a function of the viscosity of the ink, the type of solid contaminants to be removed, and the rate of build-up of contaminants. More passes of the wiper blades over the printhead orifice may be required for more viscous ink, for finer and more gritty solid contaminants and for a faster build-up. For wiper 60, for most applications, it is preferred that at least three blade tips 65 strike the printhead orifice plate each time the carriage 14 enters service station 36. A preferred number of blades 62 is 12, as shown in FIG. 7, although any other number may be used, so long as the desired number of strikes of provided. The speed of rotation can be adjusted, depending on the number of blades provided by appropriate control of the servomotor or by adjusting the gear reduction ratio between gears 72 and rack 76, in a manner known to those skilled in the art. The length of the wiper blades depends on the application, and manufacturing tolerances. For most applications, blades 62 or 92 typically are about 0.25" long, although it is to be understood that the provision of these exemplary dimensions does not serve in any way to limit the scope of the invention. The number and size of scrapers 80 is again a function of the particular application. Typically, more than one scraper is used, and a minimum of three scrapers 80 is recommended.

The operation of the preferred embodiment of this invention will now be described with particular reference to FIGS. 4-6. Typically, carriage 14 enters service station 36 at the completion of each line of print on a printing medium, although the printer could be designed for less frequent servicing operations, in accordance with the printing requirements of the user. As printhead carriage 14 passes from left to right toward service station 36, as shown in FIG. 4 rack 76, which is mounted to the underside of carriage 14, engages pinion gear 74. Further movement of carriage 14 into service station 36 produces a clockwise rotation of pinion pear 74, which in turn produces a counterclockwise rotation of gear 72, and wiper 60, as shown in FIG. 4. Blades 62 of wiper 60 pass across printhead 33 in the cleaning area, wiping the printhead orifice plate 35, and removing ink, dust and other contaminants therefrom. Preferably, three tips 65 of blades 62 strike the printhead 33 during this pass of printhead 33 over wiper 60. After each blade 62 wipes printhead 33, it passes immediately over edges 82 of scrapers 80, which scrape the contaminants from blades 62. Passage of tips 65 of blades 62 over edges 82 produces a flicking action, which, when combined with the centrifugal acceleration produced by rotation of wiper 60 and with the effects of gravity, causes contaminants to travel downwardly along the surfaces of scrapers 80 toward edges 83 and into the machine.

In the printer with which this invention has been illustratively described and which utilizes a cap for the printhead, after completion of the wiping of printhead 33, pen support 54 engages projection 52, urging sled 38 to the right, as shown in FIG. 5, and bringing cap 56 into alignment with printhead 33 and pen catcher 57 into alignment with slot 58. Bosses 44 of sled 38 ride up ramps 46 from position 48 to position 50. This movement raises cap 56 upwardly to cap printhead 33 and raises pen catcher 57 into slot 58 on carriage 14, as carriage 14 comes to rest at the extreme right-hand end of service station 36, as shown in FIG. 6.

As printhead carriage 14 moves from right to left out of service station 36, the operation is reversed. Pen catcher 57, which resides in slot 58, urges sled 38 in a leftward direction, causing it to slide down ramps 46 from position 50 to position 48. At this point, printhead 38 is uncapped and pen catcher 57 pops out of slot 58. As pinion gear 74 is rotated in a counterclockwise direction by rack 76, pear 72 and wiper 60 are rotated in a clockwise direction. Wiper 60 again wipes printhead 33 in a direction opposite of the movement of printhead 33. Thereafter, carriage 14 continues traveling to the left, as shown in FIG. 4, to perform the desired printing operation.

The wiper of this invention permits the removal of dust, ink and other contaminants from printhead 33, and prevents their buildup during use. The wiper of this invention is superior to that found in the prior art, since the rapidly rotating wiper blades provide multiple wipes of printhead 33 in a very short period of time providing an efficient wiping action and one which will not damage printhead 33. The repeated wipings are sufficient to adequately clean the printhead. The scrapers allow automatic self cleaning of the blades after each pass over the printhead orifice plate, so that as a wiper blade strikes the orifice plate, it has just been cleaned and does not recontaminate the orifice plate with previously removed ink or other contaminants. The wiper may be automatically actuated by passage of the printhead carriage into the service station, by a simplified, dependable mechanical design which is not easily subject to failure, or by a servomotor.

In view of the above description, it is likely that modifications and improvements will occur to those skilled in the art which are within the scope of this invention The above description is intended to be exemplary only, the scope of the invention being defined by the following claims and their equivalents.

What is claimed is:

1. Apparatus for cleaning an orifice plate of a printhead on an ink-jet printer comprising:

a wiper having a central axis of rotation and a plurality of resilient blades extending therefrom, each said resilient blade having a distal tip, wherein said distal tips of said resilient blades together define a circle whose center is on said central axis of rotation;

means for rotating said wiper about said central axis for successively bringing said distal tips of said resilient blades into wiping contact with the printhead orifice plate; and means for removing contaminants from said resilient blades while said resilient blades are rotating, wherein said removing means comprises a plurality of generally rigid scraper blades disposed about a portion of a circumference of the circle defined by said distal tips of said resilient blades.

2. Apparatus as recited in claim 1 wherein:

said wiper blades extend generally radially outwardly from said central axis; and said means for rotating comprises means for rotary wiping of the orifice plate with said wiper in one rotary direction and for rotary wiping of the orifice plate with said wiper in an opposite rotary direction.

3. Apparatus as recited in claim 1 wherein said rigid blades have an orientation generally parallel to a radius passing through said axis.

4. Apparatus as recited in claim 1 wherein wiping of the printhead orifice plate occurs in a cleaning area spaced from a printing area; and said means for rotating comprises means for rotary wiping of the orifice plate with said wiper in one rotary direction while moving the printhead in one linear direction in the cleaning area such that the orifice plate is wiped by said wiper in a direction opposite of said one direction of linear motion of said orifice plate, and for rotary wiping of the orifice plate with said wiper in a rotary direction opposite of said one rotary direction while moving the printhead in a linear direction opposite of said one linear direction in the cleaning area.

5. Apparatus as recited in claim 1 wherein said removing means engages said blade more than once after each wiping contact between said blade and the printhead orifice plate.

6. Apparatus as recited in claim 1 wherein said rotating means comprise a rack associated with the printhead for driving a gear associated with said wiper.

7. Apparatus as recited in claim 6 wherein the printhead is disposed on a carriage, and wherein said rack is secured to said printhead carriage.

8. Apparatus as recited in claim 1 wherein each of said resilient blades is disposed generally parallel to a radius passing through said axis.

9. Apparatus as recited in claim 1 wherein each of said resilient blades is disposed at an angle with respect to a radius passing through said axis.

10. Apparatus as recited in claim 1 wherein said means for rotating comprises means for bringing more than one of said wiper blades distal tips into wiping contact with the printhead orifice plate.

11. Apparatus as recited in claim 1 wherein:

said circle has a circumference;

said means for rotating comprises means for rotating said wiper about said central axis of rotation to bring said distal tips of said wiper blades into wiping contact with the printhead orifice plate in a cleaning area, said cleaning area being generally disposed on a portion of the circumference of said circle;

said means for removing is generally disposed on the circumference of said circle in spaced relation with said cleaning area for removing contaminants from said wiper blades; and said plurality of scraper blades comprises a plurality of rigid scraping blades disposed along a portion of the circumference of said circle.

12. Apparatus for cleaning an orifice plate of a printhead on an ink-jet printer comprising:

a wiper having a central axis of rotation and at least one resilient blade extending therefrom, said at least one blade having a distal tip;

means for rotating said wiper about said central axis for bringing said distal tip of said at least one blade into wiping contact with the printhead orifice plate; and means for removing contaminants from said at least one blade while said at least one blade is rotating, wherein said removing means comprises a liquid absorbing layer of material positioned to contact at least said distal tip of said at least one blade while said at least one blade is rotating.

13. Apparatus as recited in claim 12 wherein said removing means further comprises a roller containing said layer of material, said roller being positioned so that said distal tip engages said roller after wiping the printhead orifice plate.

14. Apparatus as recited in claim 13 wherein said roller is freely rotatable about a shaft, said shaft being generally coincident with said central axis.

15. Apparatus as recited in claim 12 wherein:

said apparatus further comprises a station for servicing the printhead, and means for repeatedly moving the printhead into said service station;

said wiper is disposed in said service station;

said means for rotating comprises means for rotating said rotary wiper about said central axis of rotation when the printhead is disposed in said service station to bring said distal tip of said at least one wiper blade into wiping contact with the printhead orifice plate in a cleaning area, wherein rotary movement of said distal tip about said central axis of rotation generally defines a circumference of a circle;

said means for removing is generally disposed in spaced relation with said cleaning area for removing contaminants from said at least one blade; and said liquid absorbing layer of material is generally disposed on the circumference of said circle.

16. Apparatus as recited in claim 12 wherein:

said wiper comprises a plurality of blades, each of said blades having a distal tip, said distal tips together generally defining a circle having a circumference;

said means for rotating comprises means for rotating said rotary wiper about said central axis of rotation to bring said distal tips of said wiper blades into wiping contact with the printhead orifice plate in a cleaning area, said cleaning area being generally disposed on a portion of the circumference of said circle;

said means for removing is generally disposed on the circumference of said circle in spaced relation with said cleaning area for removing contaminants from said wiper blades; and said liquid absorbing layer of material generally disposed on the circumference of said circle and positioned to contact at least said distal tips while said wiper blades are rotating.

17. Apparatus for cleaning an orifice plate of a printhead on an ink-jet printer comprising:

a carriage for carrying the printhead;

a station for servicing the printhead;

means for moving said carriage into said service station;

a rotary wiper disposed in said service station, said wiper having a plurality of blades, each of said blades having a distal tip, said distal tips generally defining a circle having a circumference;

means for rotating said wiper about a central axis of rotation when said carriage is disposed in said service station to bring said distal tips of said wiper blades into wiping contact with the printhead orifice plate in a cleaning area, said cleaning area being generally disposed on a portion of the circumference of said circle, said means for rotating comprising means for rotary wiping of the printhead orifice plate with said wiper in one rotary direction and for rotary wiping of the printhead orifice plate with said wiper in an opposite rotary direction; and means generally disposed on the circumference of said circle in spaced relation with said cleaning area for removing contaminants from said wiper blades.

18. Apparatus as recited in claim 17 wherein said wiper blades extend radially from said central axis of rotation.

19. Apparatus as recited in claim 17 wherein said wiper blades are disposed at an angle with respect to a radius extending from said central axis of rotation.

20. Apparatus as recited in claim 17 wherein said removing means comprises a plurality of rigid, scraping blades generally disposed along a portion of the circumference of said circle.

21. Apparatus as recited in claim 17 wherein said removing means comprises a layer of a liquid absorbing material generally disposed on the circumference of said circle so as to enable said material to contact at least said distal tips while said wiper blades are rotating.

22. Apparatus as recited in claim 21 wherein said layer of liquid absorbing material is disposed on a roller having an axis of rotation generally parallel to said central axis of rotation.

23. Apparatus as recited in claim 22 wherein said roller is freely rotatable about said axis of rotation.

24. Apparatus as recited in claim 17 further comprising means for capping the printhead after wiping thereof by said wiper.

25. Apparatus for cleaning an orifice plate of a printhead on an ink-jet printer comprising:

a carriage containing the printhead;

a station for serving the printhead;

means for moving said carriage into said service station;

a rotary wiper disposed in said service station, said wiper being rotatably disposed about a central axis, said wiper having a plurality of blades extending radially from said central axis, each of said blades having a distal tip, said distal tips generally defining a circumference of a circle;

means for rotating said wiper about said central axis thereof when said carriage is disposed in said service station to bring said distal tips of said wiper blades into wiping contact with the printhead orifice plate in a cleaning area of said service station, said cleaning area being generally disposed along a portion of the circumference of said circle, said rotating means comprising:

a rack disposed on said printhead carriage;

a shaft coincident with said central axis; and means coupling said rack to said shaft; and a plurality of generally rigid scraping blades disposed generally along a portion of the circumference of said circle in spaced relation with said cleaning area for removing contaminants from said wiper blades.

26. Apparatus for cleaning an orifice plate of a printhead on an ink-jet printer comprising:

a wiper having a central axis of rotation and at least one resilient blade extending from said central axis of rotation, said blade having a distal tip;

means for rotating said wiper about said central axis for bringing said distal tip of said at least one blade into wiping contact with the printhead orifice plate, wherein said rotating means comprises a rack associated with the printhead for driving a gear associated with said wiper, said means for rotating comprising means for rotary wiping of the printhead orifice plate with said wiper in one rotary direction and for rotary wiping of the printhead orifice plate with said wiper in an opposite rotary direction; and means for removing contaminants from said at least one blade while said at least one blade is rotating.

27. Apparatus as recited in claim 26 further comprising:

a carriage on which the printhead is disposed; and a station for serving the printhead;

wherein said rack is secured to said printhead carriage, and wherein said means for rotating is actuated only upon entry of said carriage into said service station.

28. Apparatus for cleaning an orifice plate of a printhead on an ink-jet printer comprising:

a station for servicing the printhead;

means for repeatedly moving the printhead into said service station;

a rotary wiper disposed in said service station, said wiper having at least one blade, said at least one blade having a distal tip;

means for rotating said rotary wiper about a central axis of rotation when the printhead is disposed in said service station to bring said distal tip of said at least one wiper blade into wiping contact with the printhead orifice plate in a cleaning area, wherein rotary movement of said distal tip about said central axis of rotation generally defines a circumference of a circle; and means generally disposed in spaced relation with said cleaning area for removing contaminants from said at least one blade, said removing means comprising a plurality of rigid, scraping blades generally disposed along a portion of the circumference of a circle.

29. Apparatus for cleaning an orifice plate of a printhead on an ink-jet printer comprising:

a station for servicing the printhead;

means for repeatedly moving the printhead into said service station;

a rotary wiper disposed in said service station, said wiper having at least three blades each having a distal tip;

means for rotating said rotary wiper about a central axis of rotation when the printhead is disposed in said service station to bring at least a said distal tip into wiping contact with the printhead orifice plate in a cleaning area, wherein said means for rotating comprises means for coordinating rotation of said wiper with movement of the printhead such that at least three of said wiper blade distal tips are brought into wiping contact with the printhead orifice plate each time that said carriage is disposed in said service station; and means generally disposed in spaced relation with said cleaning area for removing contaminants from said at least one blade.

30. A method for cleaning an orifice plate of a printhead on an ink-jet printer, comprising the steps of:

moving the printhead from a printing area of the printer into a cleaning area of the printer separate from the printing area;

after said moving step, first rotary wiping of the orifice plate in one rotary direction; and second rotary wiping of the orifice plate in an opposite rotary direction.

31. A method as recited in claim 30, wherein:

said first rotary wiping step comprises moving the printhead in one linear direction in the cleaning area such that the orifice plate is wiped in a direction opposite to a direction of motion of said orifice plate; and said second rotary wiping step comprises thereafter moving the printhead in another linear direction, opposite to the aforesaid one linear direction of the printhead, in the cleaning area such that the orifice plate is again wiped in a direction opposite to a direction of linear motion of said orifice plate in the cleaning area.

32. A method as recited in claim 30 wherein:

said first rotary wiping step comprises wiping the orifice plate with a rotary wiper;

said second rotary wiping step comprises wiping the orifice plate with the rotary wiper; and said method for cleaning further comprises, during said wiping step, removing contaminants from said rotary wiper.

33. A method as recited in claim 32 wherein said removing step comprises removing contaminants more than once from the rotary wiper after each wiping contact between the rotary wiper and the orifice plate.

34. A method as recited in claim 32 wherein said removing step comprises engaging the rotary wiper to cause flexing of the rotary wiper such that contaminants are flung therefrom.

35. A method as recited in claim 32 wherein said removing step comprises absorbing contaminants from the rotary wiper.

36. A method as recited in claim 32 wherein:

the rotary wiper comprises a plurality of blades each having a distal tip;

said first rotary wiping step comprises bringing a plurality of the wiper blades distal tips into wiping contact with the printhead orifice plate; and said second rotary wiping step comprises bringing a plurality of the wiper blades distal tips into wiping contact with the printhead orifice plate.

37. Apparatus for cleaning an orifice plate of a printhead on an ink-jet printer comprising:

a station for servicing the printhead;

means for repeatedly moving the printhead into said service station;

a rotary wiper disposed in said service station, said wiper having at least one blade, said at least one blade having a distal tip;

means for rotating said rotary wiper about a central axis of rotation when the printhead is disposed in said service station to bring said distal tip of said at least one wiper blade into wiping contact with the printhead orifice plate in a cleaning area, wherein said means for rotating comprises means for first rotary wiping of the printhead orifice plate with said rotary wiper in one rotary direction and for second rotary wiping of the printhead orifice plate with said rotary wiper in an opposite rotary direction; and means generally disposed in spaced relation with said cleaning area for removing contaminations from said at least one blade.

38. Apparatus for cleaning an orifice plate of a printhead on an ink-jet printer comprising:

a rotary wiper, said wiper having a plurality of blades, each of said blades having a distal tip, said distal tips together generally defining a circle having a circumference;

means for rotating said rotary wiper about a central axis of rotation to bring said distal tips of said wiper blades into wiping contact with the printhead orifice plate in a cleaning area, said cleaning area being generally disposed on a portion of the circumference of a circle, wherein said means for rotating comprises means for rotary wiping of the printhead orifice plate with said rotary wiper in one rotary direction while moving the printhead in one linear direction in the cleaning area such that the printhead orifice plate is wiped by said rotary wiper in a direction opposite of a direction of linear motion of said printhead orifice plate, and for rotary wiping of the printhead orifice plate with said rotary wiper in an opposite rotary direction while moving the printhead in an opposite linear direction in the cleaning area such that the printhead orifice plate is wiped by said rotary wiper in a direction opposite of a direction of linear motion of said printhead orifice plate in the cleaning area; and means generally disposed on the circumference of said circle in spaced relation with said cleaning area for removing contaminants from said wiper blades.

39. A method as recited in claim 38 wherein said means for rotating comprises means for bringing more than one of said wiper blades distal tips into wiping contact with the printhead orifice plate.

* * * * *